US008576149B2

(12) United States Patent
Zhao

(10) Patent No.: US 8,576,149 B2
(45) Date of Patent: Nov. 5, 2013

(54) LIQUID CRYSTAL DISPLAY

(75) Inventor: Dengxia Zhao, Guangdong (CN)

(73) Assignee: Shenzhen China Star Optoelectronics Technology Co. Ltd., Guangdong (CN)

( * ) Notice: Subject to any disclaimer, the term of this patent is extended or adjusted under 35 U.S.C. 154(b) by 228 days.

(21) Appl. No.: 13/145,909

(22) PCT Filed: May 19, 2011

(86) PCT No.: PCT/CN2011/074349

§ 371 (c)(1),
(2), (4) Date: Jul. 22, 2011

(87) PCT Pub. No.: WO2012/151761

PCT Pub. Date: Nov. 15, 2012

(65) Prior Publication Data

US 2012/0287107 A1 Nov. 15, 2012

(51) Int. Cl.
*G09G 3/36* (2006.01)

(52) U.S. Cl.
USPC ..... 345/87; 345/204; 345/214

(58) Field of Classification Search
None
See application file for complete search history.

(56) References Cited

U.S. PATENT DOCUMENTS 7,688,394 B2 * 3/2010 Yasui et al. ..... 349/48

FOREIGN PATENT DOCUMENTS

| | | |
|---|---|---|
| CN | 1409292 | 4/2003 |
| CN | 101320170 | 12/2008 |
| CN | 102034443 | 4/2011 |
| JP | 2008282018 | 11/2008 |
| WO | 9500874 | 1/1995 |

OTHER PUBLICATIONS

International Searching Authority, "International Search Report," with English translation, issued in connection with international application serial No. PCT/CN2011/074349, mailed Mar. 1, 2012, 10 pages.

* cited by examiner

*Primary Examiner* — Joseph Haley
(74) *Attorney, Agent, or Firm* — Banner & Witcoff, Ltd.

(57) ABSTRACT

This invention discloses an LCD which includes an LCD panel and a pixel voltage adjuster. The LCD panel includes a plurality of pixel units which are arranged in the way of a matrix. Each pixel unit is provided with a liquid crystal capacitor. The liquid crystal capacitor includes a pixel electrode and a common electrode oppositely arranged. The pixel voltage adjuster receives a feedback common voltage from the common electrode and adjusts the voltage of the pixel electrode in terms of the feedback common voltage. The LCD provided in this invention can reduce cross-noise and improve the display quality of the LCD.

16 Claims, 3 Drawing Sheets

| | | |
|---|---|---|
| B | B | B |
| B | A | B |
| B | B | B |

LIQUID CRYSTAL DISPLAY

This application is a National Stage application of co-pending PCT application PCT/CN2011/074349 filed 19 May 2011, which claims the benefit of the CN Application No. 201110118646.6 filed 9 May 2011. These applications are incorporated herein by reference in their entireties for any and all purposes.

FIELD OF THE INVENTION

This invention relates to the technical field of display, particularly to a liquid crystal display.

BACKGROUND OF THE INVENTION

A liquid crystal display (LCD) is a flat panel display widely used at present, which has the advantages of thin and light appearance, electricity economization and no radiation. The operating principle of LCD is that the voltage difference at the two ends of a liquid crystal layer is utilized to change the arrangement state of liquid crystal molecules in the liquid crystal layer, so as to change the light transmission of the liquid crystal layer, and display the image by cooperating the light source provided by a backlight module.

FIG. 1 is the schematic diagram for the circuit structure of an existing LCD. The LCD includes an LCD panel 110, a common voltage generator 15, a scanning driver 17 and a data driver 16, wherein the LCD panel 110 includes a plurality of scanning lines 9 and a plurality of data lines 14, the scanning lines 9 and the data lines 14 are crosswise arranged by way of insulation, thereby defining a plurality of pixel units 100 arranged in the way of a matrix.

Each pixel unit 100 is provided with a thin film transistor 10, a liquid crystal capacitor 12 and a storage capacitor 13. The liquid crystal capacitor 12 includes a pixel electrode 121 and a common electrode 122 oppositely arranged and a liquid crystal layer (not shown in the figure) sandwiched between the both. The storage capacitor 13 includes the pixel electrode 121 and a storage electrode 132 oppositely arranged and the insulating material (not shown in the figure) sandwiched between the both. Besides, the data lines 14, the common electrode 122 and the liquid crystal layer between the both generally form a parasitic capacitor 11.

The thin film transistor 10 includes a gate electrode, a source electrode and a drain electrode, wherein the gate electrode is connected with one of the scanning lines 9, the source electrode is connected with one of the data lines 14, and the drain electrode is connected with the pixel electrode 121.

The scanning driver 17 is used for outputting a plurality of scanning signals in sequence to each of scanning lines 9, when the scanning driver 17 outputs scanning signals to one line of scanning lines 9, the thin film transistor 10 connected with the line of scanning lines 9 is conducted, and meanwhile, the data driver 16 provides a plurality of gray-scale voltages to the plurality of data lines 14, thereby causing the gray-scale voltages to be loaded to the pixel electrode 121 through the source electrode and the drain electrode of the conducted thin film transistor 10.

The common voltage generator 15 is used for providing the common voltage Vcom to the common electrode 122 and the storage electrode 132. Therefore, after the gray-scale voltages are loaded to the pixel electrode 121 through the source electrode and the drain electrode of the conducted thin film transistor 10, the liquid crystal in the liquid crystal capacitor 12 deflects due to a voltage difference between the common voltage and the gray-scale voltages on the liquid crystal capacitor 12, thereby displaying the required gray scale according to the deflection angle of the liquid crystal. The function of the storage capacitor 13 is to maintain the gray-scale voltage on the pixel electrode 121, so as to keep the gray-scale voltage on the pixel electrode 121 lasting until the arrival of the next gray-scale voltage.

Please also refer to FIG. 2. FIG. 2 shows the arrangement diagram for pixel units 100 of a certain exemplary region of the LCD. The region is a pixel region in the size of 3*3, the middle pixel units 100 are represented by A, and the surrounding pixel units 100 are represented by B.

For a certain pixel unit A, the gray-scale voltages provided on the data lines 14 of the pixel units B certainly change when the image gray scale required to be displayed on the pixel units B surrounding the certain pixel unit A changes. At this moment, due to the fact that the voltage of the parasitic capacitor 11 of the pixel units B can not instantly change, the voltage of the common electrode 122 of the pixel units B fluctuates. Whereas, the common electrode 122 of each pixel unit is communicated, so the voltage of the common electrode 122 of the pixel unit A fluctuates as well. For example, for an ever-light type LCD, the gray-scale voltages on the data lines 14 of the pixel units B increase B when the pixel units B surrounding the pixel unit A displaying the bright state change from bright to dark; due to the fact that the voltage of the parasitic capacitor 11 of the pixel units B can not instantly change, the voltage of the common electrode 122 of the pixel units B fluctuates upwards, therefore, the voltage of the common electrode 122 of the pixel unit A displaying the bright state also fluctuates upwards. On the contrary, the voltage of the common electrode 122 of the pixel unit A fluctuates downwards when the pixel units B surrounding the pixel unit A displaying the bright state change from dark to bright.

Likewise, the problem that the voltage of the common electrode 122 fluctuates upwards or downwards exists in a plurality of single pixel units 100 of the LCD, and the common electrodes 122 of the pixel units 100 are communicated, therefore, the problem that the whole voltage of the common electrode 122 of the LCD fluctuates upwards or downwards easily generates the phenomenon of cross noise, thereby greatly influencing the display quality of the LCD.

SUMMARY OF THE INVENTION

Aspects of the invention relate to providing an LCD, which has the advantages of reducing the cross noise and improving the display quality of the LCD.

This invention provides an LCD which includes an LCD panel. The LCD panel includes a plurality of pixel units arranged in the way of a matrix. Each pixel unit is provided with a liquid crystal capacitor. The liquid crystal capacitor includes a pixel electrode and a common electrode oppositely arranged. The LCD further includes a pixel voltage adjuster, wherein the pixel voltage adjuster includes a plurality of compensation capacitors and a unity gain amplifier. Each pixel unit is provided with the compensation capacitor. The compensation capacitor includes the pixel electrode and a feedback common electrode oppositely arranged. The input end of the unity gain amplifier is connected with the common electrode and the output end thereof is connected with the feedback common electrode.

Preferably, the LCD includes a plurality of scanning lines and a plurality of data lines, wherein the scanning lines and the data lines are crosswise arranged by way of insulation to define the pixel units. Each pixel unit includes a thin film transistor. The thin film transistor includes a gate electrode, a source electrode and a drain electrode. The gate electrode is connected with one of the scanning lines; the source electrode is connected with one of the data lines and the drain electrode is connected with the pixel electrode.

Preferably, each pixel unit further includes a storage capacitor, wherein the storage capacitor includes the pixel electrode and a storage electrode that are oppositely arranged. The storage electrode and the common electrode receive the same common voltage.

Preferably, the LCD further includes a common voltage generator. The common voltage generator is used for providing common voltage to the storage electrode and the common electrode.

Preferably, the LCD further includes a scanning driver. The scanning driver is used for providing the scanning signals to the scanning lines.

Preferably, the LCD further includes a data driver. The data driver is used for providing the gray-scale voltages to the data lines.

Preferably, the capacitance of the compensation capacitor is twice as much as that of the liquid crystal capacitor.

Preferably, a size of the LCD is smaller than or equal to 32 inches.

This invention also provides an LCD which includes an LCD panel. The LCD panel includes a plurality of pixel units arranged in the way of a matrix. Each pixel unit is provided with a liquid crystal capacitor. The liquid crystal capacitor includes a pixel electrode and a common electrode oppositely arranged. The LCD further includes a pixel voltage adjuster, wherein the pixel voltage adjuster receives the feedback common voltage from the common electrode and adjusts the voltage of the pixel electrode according to the feedback common voltage.

Preferably, each pixel unit further includes a storage capacitor. The storage capacitor includes the pixel electrode and a storage electrode oppositely arranged. The storage electrode and the common electrode receive the same common voltage.

Preferably, the pixel voltage adjuster includes a plurality of compensation capacitors and two unity gain amplifiers. Each pixel unit is provided with the compensation capacitor. The compensation capacitor includes the pixel electrode and a feedback common electrode oppositely arranged. The LCD includes two parts which are vertically symmetrical, wherein the input end of one unity gain amplifier is connected with the common electrode of each pixel unit on the upper part; the output end thereof is connected with the feedback common electrode of the compensation capacitor in each pixel unit on the upper part. The input end of another unity gain amplifier is connected with the common electrode of each pixel unit on the lower part; the output end thereof is connected with the feedback common electrode of the compensation capacitor in each pixel unit on the lower part.

Preferably, the LCD panel includes a plurality of scanning lines and a plurality of data lines. The scanning lines and the data lines are crosswise arranged by way of insulation to define the pixel units. Each pixel unit includes a thin film transistor. The thin film transistor comprises a gate electrode, a source electrode and a drain electrode. The gate electrode is connected with one of the scanning lines; the source electrode is connected with one of the data lines and the drain electrode is connected with the pixel electrode.

Preferably, the LCD further includes a common voltage generator. The common voltage generator is used for providing the common voltage to the storage electrode and the common electrode.

Preferably, the LCD further includes a scanning driver. The scanning driver is used for providing the scanning signals to the scanning lines.

Preferably, the LCD further includes a data driver. The data driver is used for providing the gray-scale voltages to the data lines.

Preferably, the capacitance of the compensation capacitor is twice as much as that of the liquid crystal capacitor.

Preferably, a size of the LCD is larger than 32 inches.

Preferably, a size of the LCD is 37 inches or 40 inches.

Compared with the prior art, the LCD provided by this invention further includes a pixel voltage adjuster. The pixel voltage adjuster can receive the feedback common voltage from the common electrode and adjust the voltage of the pixel electrode according to the feedback common voltage, so that the voltage of pixel electrode keeps the synchronous change with the common voltage, thereby compensating the fluctuation of the common voltage, effectively improving the phenomenon of cross noise, and raising the display quality of the LCD.

DESCRIPTION OF ATTACHED DRAWINGS

The purpose realization, function characteristics and advantages of this invention are further explained by combination with the embodiments and in reference to the attached drawings.

DETAILED DESCRIPTION OF THE EMBODIMENTS

It is to be noted that the described specific embodiments are only for explanation of this invention, not for limitation of this invention.

Figures 1, 2:
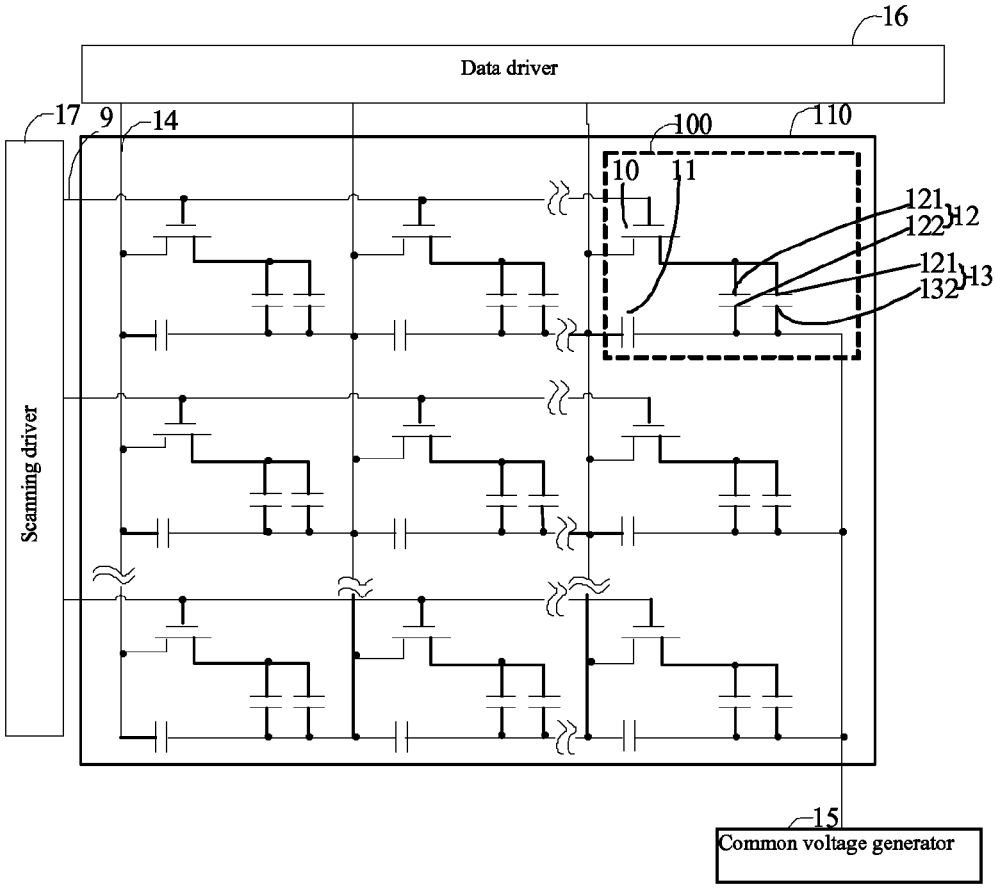
FIG. 1 is the schematic diagram for the circuit structure of an LCD in the prior art.
FIG. 2 is the arrangement diagram for pixel units of a certain exemplary region of the LCD shown in FIG. 1.
Figure 3:
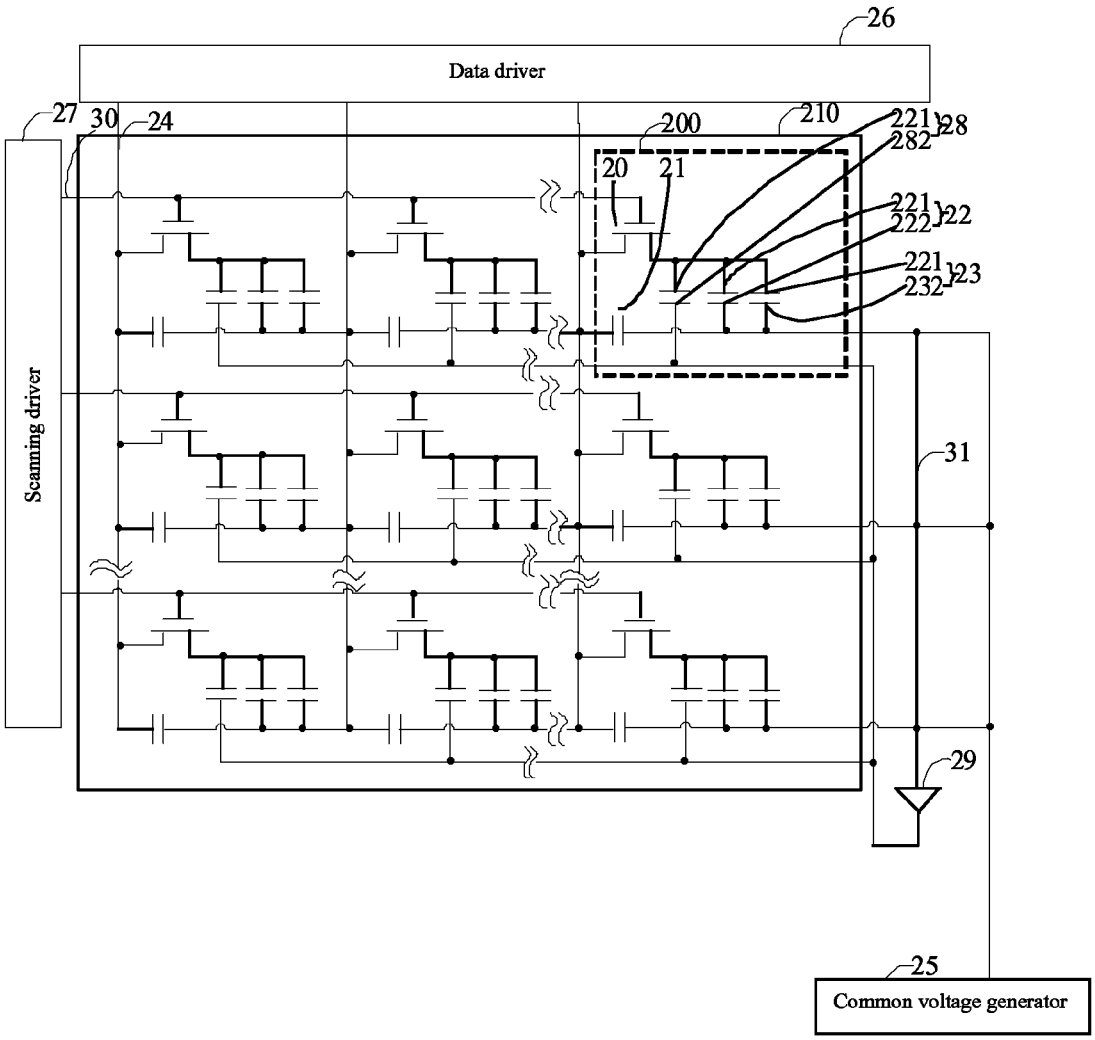
FIG. 3 is the schematic diagram for the circuit structure of the LCD provided in the first embodiment of this invention.

Please refer to FIG. 3. FIG. 3 is the schematic diagram for the circuit structure of the LCD provided in the first embodiment of this invention. The LCD includes an LCD panel 210, a common voltage generator 25, a pixel voltage adjuster, a scanning driver 27 and a data driver 26, wherein the pixel voltage adjuster includes a plurality of compensation capacitors 28 and a unity gain amplifier 29. The LCD can be the LCD in a size smaller than or equal to 32 inches.

The LCD panel 210 includes a plurality of scanning lines 30 and a plurality of data lines. The scanning lines 30 and the data lines 24 are crosswise arranged by way of insulation to define a plurality of pixel units 200 arranged in the way of a matrix. Each pixel unit 200 is provided with a thin film transistor 20, a liquid crystal capacitor 22, a storage capacitor 23 and the compensation capacitor 28. The liquid crystal capacitor 22 includes a pixel electrode 221 and a common electrode 222 oppositely arranged and a liquid crystal layer (not shown in the figure) sandwiched between the both.

The storage capacitor 23 includes the pixel electrode 221 and a storage electrode 223 oppositely arranged and the insulating material (not shown in the figure) sandwiched between the both. The compensation capacitor 28 includes the pixel electrode 221 and a feedback common electrode 282 oppositely arranged and the insulating material (not shown in the figure) sandwiched between the both. Besides, the data lines 24, the common electrode 222 and liquid crystal layer between the both generally form a parasitic capacitor 21.

The input end of the unity gain amplifier 29 is connected with the common electrode 222 of each pixel unit 200 through feedback lines 31, and the output end thereof is connected with the feedback common electrode 282 of the compensation capacitor 28 in each pixel unit 200. The unity gain amplifier 29 is used for receiving the feedback common voltage VCOM' from the common electrode 222, and amplifying the current thrust, thereby causing the voltage of the feedback common electrode 282 of the compensation capacitor 28 to be quickly charged or discharged to the feedback common voltage VCOM'.

A thin film transistor 20 includes a gate electrode, a source electrode and a drain electrode. Wherein, the gate electrode is connected with one of the scanning lines 30, the source electrode is connected with one of the data lines 24, and the drain electrode is connected with the pixel electrode 221.

A scanning driver 27 is used to output a plurality of scanning signals to every scanning line 30 in sequence. When the scanning driver 27 outputs a scanning signal to one line of scanning lines 30, the thin film transistor 20 connected to the line of scanning lines 30 is conducted. Meanwhile, a data driver 26 provides a plurality of gray-scale voltage to a plurality of data lines 24, so as to load the gray-scale voltage to pixel electrode 221 through the source electrode and the drain electrode of the conducted thin film transistor 20.

A common voltage generator 25 is used to provide a common voltage Vcom to the common electrode 222 and the storage electrode 232. Therefore, after the gray-scale voltage is loaded on the pixel electrode 221 through the source electrode and the drain electrode of the conducted thin film transistor 20, the liquid crystal of the liquid crystal capacitor 22 deflects due to a voltage difference of the common voltage and the gray-scale voltage on the liquid crystal capacitor 22, thereby displaying the required gray-scale in terms of the deflection angle of the liquid crystal. A storage capacitor 23 is used to maintain the gray-scale voltage on the pixel electrode 221, so as to keep the gray-scale voltage on the pixel electrode 221 until the arrival of the next gray-scale voltage.

In this embodiment, capacitance of the compensation capacitor 28 may be twice as much as that of the liquid crystal capacitor 22.

Compared with the prior art, the LCD provided in this invention further includes a pixel voltage adjuster. In the way, when gray-scale voltage provided on the data line 24 changes, the common voltage VCOM on the storage electrode 232 and the common electrode 222 fluctuates due to the parasitic capacitor 21. A unity gain amplifier 29 of the pixel voltage adjuster receives feedback common voltage VCOM' from the common electrode 222, and feeds back the feedback common voltage VCOM' to the feedback common electrode 282 of the compensation capacitor 28 immediately. Voltage of the compensation capacitor 28 which is based on the pixel voltage adjuster can not instantly change, when the voltage of the feedback common electrode 282 changes, the voltage on the pixel electrode 221 of the pixel unit 200 changes correspondingly. Therefore, the voltage of the pixel electrode 221 can change with the common voltage VCOM simultaneously, thereby compensating the fluctuation of common voltage Vcom, improving the cross-noise phenomenon effectively, and enhancing the display quality of the LCD.

Figure 4:
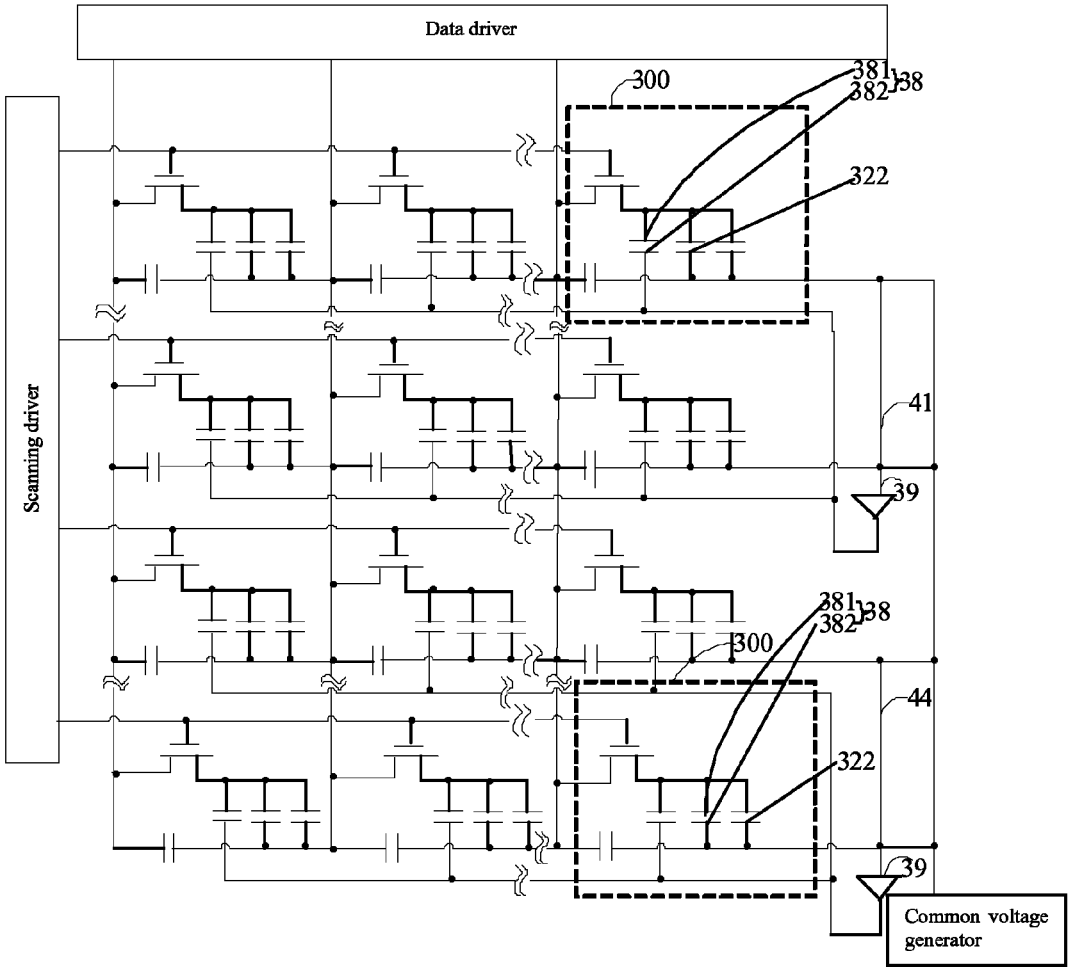
FIG. 4 is the schematic diagram for the circuit structure of the LCD provided in the second embodiment of this invention.

Refer to FIG. 4, which is the circuit structure diagram of the LCD provided in the second embodiment of the invention. The size of the LCD may be larger than 32 inches, such as 37 inches and 40 inches. The LCD of the second embodiment is approximately the same as the LCD of the first embodiment, and the differences lie in: the pixel voltage adjuster of the LCD of the second embodiment includes two unity gain amplifiers 39, and the LCD includes two parts which are vertically symmetrical (not numbered), wherein, pixel units 300 on the upper part share one unity gain amplifier 39, and pixel units 300 on the lower part share another unity gain amplifier 39.

A compensation capacitor 38 includes a pixel electrode 381, a feedback common electrode 382 oppositely arranged and insulating materials (not shown in the figure) sandwiched between the both. The input end of one unity gain amplifier 39 is connected with a common electrode 322 of every pixel unit 300 on the upper part through a feedback line 41, and the output end is connected with the feedback common electrode 382 of the compensation capacitor 38 in every pixel unit 300 on the upper part. The input end of another unity gain amplifier 39 is connected with the common electrode 322 of every pixel unit 300 on the lower part through a feedback line 44, and the output end is connected with the feedback common electrode 382 of compensation capacitor 38 in every pixel unit 300 on the lower part.

The LCD provided in this invention is not limited to what the first and the second embodiment have stated, and the number of unity gain amplifiers is not limited to one or two, which can be more according to the increase of the size of LCD, and the location of unity gain amplifiers also can be arranged in terms of actual needs.

The statements are preferable embodiments in this invention, not limiting the scope of patent of this invention thereof. Equivalent structures or equivalent transformation processes made with contents of the description and figures of this invention, or applying the contents of the description and figures of this invention in other relevant technical fields are all included in the scope of patent protection of this invention for the same reason.

What is claimed is:

1. An LCD comprising:

a LCD panel comprising a plurality of pixel units which are arranged in matrix, each pixel unit being provided with a liquid crystal capacitor, the liquid crystal capacitor comprising a pixel electrode and a common electrode oppositely arranged;

a pixel voltage adjuster comprising a plurality of compensation capacitors and a unity gain amplifier, each pixel unit being provided with one of the compensation capacitors, the compensation capacitor comprising one of the pixel electrodes and a feedback common electrode oppositely arranged, the unity gain amplifier comprising an input end connected with the common electrode and an output end connected with the feedback common electrode.

2. The LCD as claimed in claim 1, the LCD panel further comprising:

a plurality of scanning lines and a plurality of data lines, the scanning lines and data lines are cross-set in an insulating way to define the pixel units, each pixel unit comprises a thin film transistor comprising:

a gate electrode connected with one of the scanning lines;

a source electrode connected with one of the data lines; and a drain electrode connected with the pixel electrode.

3. The LCD as claimed in claim 2, wherein each pixel unit further comprises a storage capacitor, the storage capacitor comprises one of the pixel electrodes and a storage electrode oppositely arranged, the storage electrode and the common electrode are configured to receive the same common voltage.

4. The LCD as claimed in claim 3, wherein the LCD further comprises a common voltage generator configured to provide a common voltage to the storage electrode and the common electrode.

5. The LCD as claimed in claim 3, wherein the LCD further comprises a scanning driver configured to provide scanning signals to the scanning lines.

6. The LCD as claimed in claim 3, wherein the LCD further comprises a data driver which is configured to provide gray-scale voltage to data lines.

7. The LCD as claimed in claim 1, wherein the capacitance of the compensation capacitor is twice as much as that of the liquid crystal capacitor.

8. The LCD as claimed in claim 1, wherein a size of the LCD which size is smaller or equal to 32 inches.

9. An LCD comprising:

a LCD panel comprising a plurality of pixel units which are arranged in matrix, each pixel unit being provided with a liquid crystal capacitor, the liquid crystal capacitor comprising a pixel electrode and a common electrode oppositely arranged, wherein the LCD further comprises a pixel voltage adjuster which receives a feedback common voltage from the common electrode and is configured to adjusts the voltage of the pixel electrode in terms of the feedback common voltage;

wherein each pixel unit further comprises a storage capacitor, the storage capacitor comprises a pixel electrode and a storage electrode oppositely arranged, and wherein the storage electrode and the common electrode are configured to receive the same common voltage;

the pixel voltage adjuster comprises a plurality of compensation capacitors and two unity gain amplifiers, each pixel unit is provided with one of the compensation capacitors, the compensation capacitor comprises one of the pixel electrodes and a feedback common electrode oppositely arranged, the LCD comprises two parts which are vertically symmetrical to form an upper part and a lower part, wherein the input end of a first unity gain amplifier is connected with the common electrode of every pixel unit on the upper part, and the output end is connected with the feedback common electrode of every pixel unit on the upper part; and the input end of a second unity gain amplifier is connected with the common electrode of every pixel unit on the lower part, and the output end is connected with the feedback common electrode of the compensation capacitor in every pixel unit on the lower part.

10. The LCD as claimed in claim 9, wherein the LCD panel further comprises a plurality of scanning lines and data lines which are cross-set in an insulating way to define the pixel units, each pixel unit comprises a thin film transistor comprising a gate electrode connected with one of the scanning lines; a source electrode connected with one of the data lines; and a drain electrode connected with the pixel electrode.

11. The LCD as claimed in claim 10, wherein the LCD further comprises a common voltage generator configured to provide common voltage to storage electrode and common electrode.

12. The LCD as claimed in claim 10, wherein the LCD further comprises a scanning driver configured to provide scanning signals to scanning lines.

13. The LCD as claimed in claim 10, wherein the LCD further comprises a data driver configured to provide gray-scale voltage to data lines.

14. The LCD as claimed in claim 9, wherein the capacitance of the compensation capacitor is twice as much as that of the liquid crystal capacitor.

15. The LCD as claimed in claim 9, wherein a size of the LCD is larger than 32 inches.

16. The LCD as claimed in claim 9, wherein a size of the LCD is between 37 inches and 40 inches.

* * * * *